US005386999A

United States Patent [19]

Rice

[11] Patent Number: 5,386,999

[45] Date of Patent: Feb. 7, 1995

[54] APPARATUS AND METHOD OF PLAYING A GAME

[76] Inventor: Michael J. Rice, 130 W. Main St., Jonesborough, Tenn. 37659

[21] Appl. No.: 231,797

[22] Filed: Apr. 25, 1994

[51] Int. Cl.[6] ..... A63F 3/00

[52] U.S. Cl. ..... 273/287; 273/240

[58] Field of Search ..... 273/287, 280, 281, 273, 273/240; 434/348

[56] References Cited

U.S. PATENT DOCUMENTS

| | | | |
|---|---|---|---|
| 3,012,787 | 12/1961 | Ertel | 273/281 |
| 3,110,499 | 11/1963 | Boeskool | 434/348 |
| 3,287,827 | 11/1966 | Lippman | 434/348 |
| 3,732,629 | 5/1973 | Spitzner | 273/281 |
| 5,056,793 | 10/1991 | Sigle | 273/282 |
| 5,288,075 | 2/1994 | Kelley | 273/243 |

*Primary Examiner*—Benjamin H. Layno

[57] ABSTRACT

A drawing game board for non-competitive, socialized activity, has a base provided with a substantially flat upper surface for supporting drawing paper. Borders on the base extend upwardly from the upper surface thereof and define a paper location area. Within the border is a frame having a substantially rectangular shape provided by side sections and end sections. The frame has an upper surface and a lower surface. The lower surface of the frame is adapted to contact the drawing paper when the frame is moved downwardly within the border to hold the paper in place on the flat upper surface of the base. The frame is configured to provide a substantially rectangular drawing opening having a longitudinal dimension and a lateral dimension and is bordered by the side and end sections. A plurality of substantially rectangular shutters are placed between the side sections of the frame. The shutters are longitudinally dimensioned and laterally dimensioned such that when all of the shutters are placed side by side within the frame the paper will be substantially blocked from view. Each of the shutters has a removal element whereby it can individually be removed readily from the frame to reveal a portion of the paper or it can be placed in its view blocking position within the frame.

6 Claims, 2 Drawing Sheets

APPARATUS AND METHOD OF PLAYING A GAME

FIELD OF THE INVENTION

This invention concerns games in which multiple participants, principally children, can enjoy using their drawing skills to complete a picture of any chosen subject, human, animal or otherwise, in conjunction with the participation, in a non-competitive and not necessarily schooled manner, of other participants.

BACKGROUND OF THE INVENTION

In the world of games, including educational devices and the like, a conventional ingredient is that of competition, usually also involving various degrees of skill or enlightenment or learning, offtimes with pressures to perform, whether the competition be mental or physical in nature. Typical of such games or devices is the learning apparatus shown in U.S. Pat. No. 5,203,706 wherein letter stencil cards are selected by a child and placed over a sheet of paper whereby the child can then attempt to trace out a word. Such a device may be characterized as being "pressure oriented" in the sense that the object of the device is to make the child learn. Admittedly, where the child uses the device without other participants, he or she may experience no significant learning pressure, however, the child also will experience no need to interface in a convivial social manner with others and thus may learn the subject but no social skill.

Looking at it in another way, the rubbing apparatus of U.S. Pat. No. 4,445,868 is to be used by one child at a time and may give enjoyment thereto but cannot produce the salutary effects of social interaction with other children, particularly on a non-competitive basis.

Objects, therefore, of the present invention are: to provide a multi-participant drawing game or device which does not involve competition between the participants, but rather is based on pure involvement and cooperation; to provide such a game or device which is designed to have the element of humorous surprise for engendering a spirit of good-will among the participants; and to provide such a game or device which is easy to use and understand by young children.

SUMMARY OF THE INVENTION

These and other objects hereinafter appearing have been attained in accordance with the present invention which is defined in its broad structural embodiment as a drawing game board or case for non-competitive, socialized activity, comprising base means having a substantially flat upper surface for supporting drawing paper, border means on said base means extending upwardly from said upper surface thereof and defining a paper location area, frame means having a substantially rectangular shape provided by side sections and end sections, said frame means having an upper surface and a lower surface and preferably being affixed to said base means by hinge means, said lower surface providing hold down means adapted to contact said drawing paper when said frame means is rotated downwardly about said hinge means or simply placed vertically on top of said paper and hold it in place on said base means within the confines of said border means, said frame means being configured to provide a substantially rectangular drawing opening having a longitudinal dimension and a lateral dimension and bordered by said side and end sections, and a plurality of substantially rectangular shutter means each laterally dimensioned to be easily placed between said side sections and each longitudinally dimensioned such that when all of said shutter means are longitudinally juxtaposed, said paper will be substantially blocked from view, each said shutter means having removal means whereby it can individually be removed readily from, or placed in its view blocking position, within said frame means.

In certain preferred embodiments:

(a) each said shutter means is connected by hinge means to a portion of said frame means whereby each said shutter means can be selectively hinged away from its view blocking position by action of said removal means;

(b) said shutter means and said drawing opening are longitudinally dimensioned and respectively longitudinally positioned such that adjacent shutter means are longitudinally spaced apart between about 1/16 in. to about ¼ in. to provide drawing start enhancement;

(c) said drawing game board is provided with three shutter means each of a length and width of from about 2.5 to about 4.0 in.; and (d) said hinge means of said frame means is positioned on one end thereof, and the hinge means of each said shutter means is positioned on a side thereof such that said frame means with said shutter means in their closed or view blocking positions can be hinged conveniently upwardly for removal or placement of drawing paper on said upper surface of said base means.

In its preferred method embodiment, the present invention is defined as a multi-segment, drawing game method comprising the steps of (a) placing a sheet of drawing paper on a substantially flat support, (b) covering over at least one segment of said paper with first view blocking shutter means so as to leave a first segment exposed to view, (c) making a drawing of a selected portion of a figure on said first segment, (d) covering over said first segment with shutter means, (e) removing said shutter means from a second segment, to expose it to view, (f) making a drawing of another selected portion of said figure on said second segment, and (g) repeating steps (d), (e) and (f) with any number of additional segments as desired, and (h) removing said shutter means from all of said segments to expose the completely drawn figure to view.

BRIEF DESCRIPTION OF THE DRAWINGS

The invention will be further understood from the drawings herein of preferred embodiments, and from the following description thereof, wherein.

DETAILED DESCRIPTION OF THE INVENTION

Figure 1:
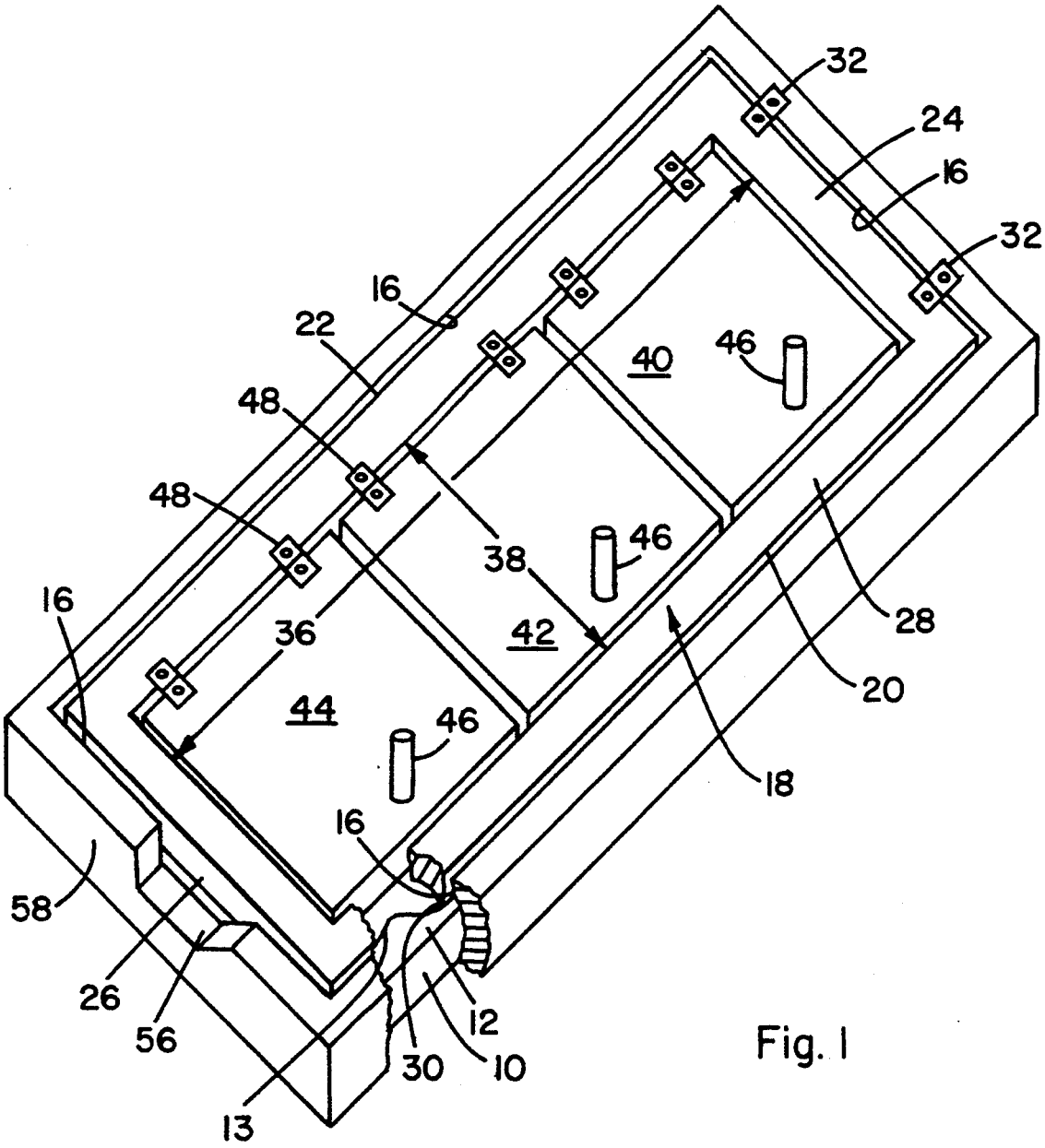
FIG. 1 is a top perspective view of the drawing game board.

Referring to the drawings and with reference to the claims hereof, the present drawing game board or case comprises base means 10 having a substantially flat upper surface 12 for supporting drawing paper 13, border means 16 on said base means extending upwardly from said upper surface thereof and defining a substantially rectangular paper location area, frame means 18 having a substantially rectangular shape provided by side sections 20, 22 and end sections 24, 26, said frame means having an upper surface 28 and a lower surface 30 and preferably being affixed to said base means by hinge means 32, said lower surface 30 providing hold down means adapted to contact said drawing paper 13 when said frame means is rotated downwardly about said hinge means and hold said paper in place on said base means, said frame means being configured to provide a substantially rectangular drawing opening generally designated 34 and having a longitudinal dimension 36 and a lateral dimension 38 and bordered by said side and end sections, and a plurality of substantially rectangular shutter means 40, 42, 44 each laterally dimensioned to be placed between said side sections 20, 22 and each longitudinally dimensioned such that when all of said shutter means are longitudinally juxtaposed, said paper will be substantially blocked from view, each said shutter means having removal means 46 whereby it can individually be easily removed from or placed in its view blocking position within said frame means.

Figure 2:
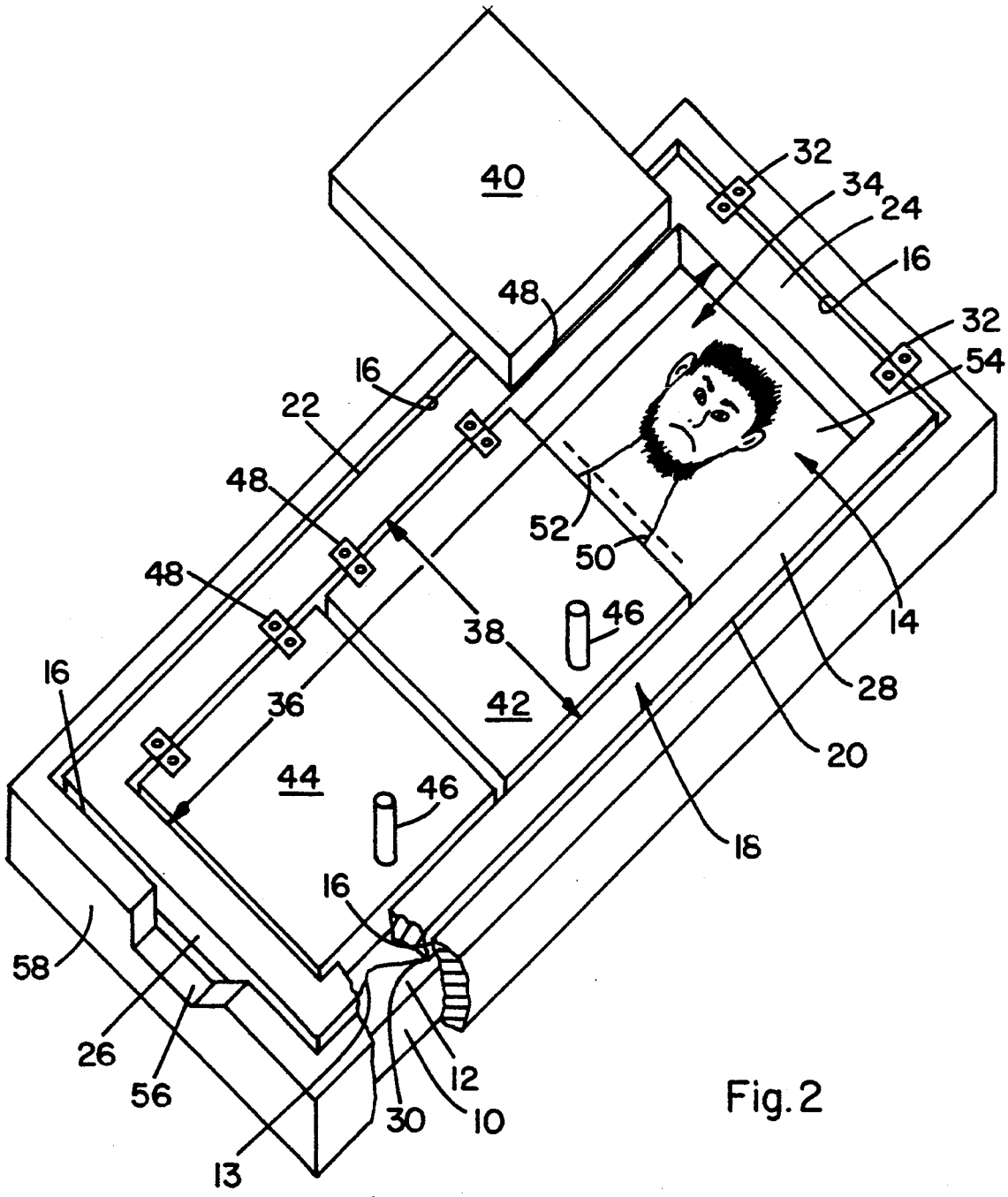
FIG. 2 is a view as in FIG. 1 wherein one of the shutter means is open and the drawing of a figure is in progress.

In the preferred embodiment, the said shutter means are longitudinally spaced apart from about 1/16 in. to about ¼ in. to provide drawing start enhancement such as the short line segments 50, 52 shown in FIG. 2. These line segments will assist the participant in starting his portion of the drawing, in-line, so to speak, with the previously drawn figure segment.

A cut-out 56 is preferably provided in an end 58 of border means 16 to provide easy finger access to end section 26 of the frame such that the frame can be lifted readily about hinges 32 to allow removal and replacement of drawing paper within the area defined by border means 16.

The dimensions of of the game board and the number of shutters may be varied depending on the size of the drawing and the number of participants desired. A suitable set of dimensions, for example, for the various structural components of the board would be of the approximate relative sizes shown in the drawings and wherein the overall length of the board is about nine to about eleven inches, its width from about four to about five inches, and its thickness about one half inch. Suitable exemplary materials of manufature for the board include wood, molded plastic, ceramic, aluminum, or any such rigid material.

In using the present drawing game board, the method set forth above is referred to, and preferably comprises:

(a) placing a sheet of drawing paper 13 on the substantially flat surface 12 of the base with the frame means 18 and affixed shutters swung upwardly on hinges 32 of the frame means to expose upper surface 12. The frame means is then swung downwardly to clamp the paper against surface 12;

(b) covering over two segments of said paper with shutter means 42, 44 so as to leave a first segment 54 of the paper exposed to view;

(c) making a drawing of a selected portion, e.g., the head of a figure on said first segment;

(d) covering over said first segment with shutter means 40;

(e) removing shutter means 42 from a second segment to expose it to view;

(f) making a drawing of another selected portion of said figure on said second segment;

(g) repeating steps (d), (e) and (f) but with any number of different additional segments as desired; and (h) removing the shutter means 40, 42, 44 from all of said segments to expose the completely drawn figure to view.

An actual exemplary set of instructions for playing the present game is as follows:

Bodybuilders . . . . is a non-competitive game developed to observe and enhance social skills in children of all ages. It's also fun for adults.

Equipment Game Case Category Cards Card Holder Game Paper

Game Play 3 players each round Place a sheet of paper in the game case. Each player picks a category card but does not reveal it to the other players. If you pick a wild card, you make up a category. Player 1 opens door 1 and draws the head of his or her category. Make sure you finish your drawing at the top of the next door. Close the door and pass the case to player 2. Player 2 opens only door 2 and draws the body of the person listed on his or her card. Close the door and let player 3 draw the legs and feet of his subject under door 3. Any player can now take the paper out and your body is complete. Switch the order of players and play again.

Optional Play - Do not use cards, only your imagination.

The invention has been described in detail with particular reference to preferred embodiments thereof, but it will be understood that variations and modifications will be effected within the spirit and scope of the invention.

I claim:

1. A drawing game board for non-competitive, socialized activity, comprising base means having a substantially flat upper surface for supporting drawing paper, border means on said base means extending upwardly from said upper surface thereof and defining a paper location area, frame means having a substantially rectangular shape provided by side sections and end sections, said frame means having an upper surface and a lower surface and being dimensioned to easily fit within said border means, said lower surface providing hold down means adapted to contact said drawing paper when said frame means is moved downwardly within said border means and hold said paper in place on said base means, said frame means being configured to provide a substantially rectangular drawing opening having a longitudinal dimension and a lateral dimension and bordered by said side and end sections, and a plurality of substantially rectangular shutter means each being laterally dimensioned to be placed between said side sections and each being longitudinally dimensioned such that when all of said shutter means are longitudinally juxtaposed, said paper will be substantially blocked from view, each said shutter means having removal means whereby it can individually be removed readily from or placed in its view blocking position within said frame means.

2. The game board of claim 1 wherein said frame means is hinged to said base means, and each said shutter means is connected by hinge means to a portion of said frame means whereby each said shutter means can be selectively hinged away from its view blocking position by action of said removal means.

3. The game board of claim 2 wherein said shutter means and said drawing opening are longitudinally dimensioned and respectively positioned such that adjacent shutter means are longitudinally spaced apart from about 1/16 in. to about ¼ in. to provide drawing start enhancement line segments.

4. The game board of claim 1 provided with three shutter means each of a length and width of from about 2.5 to about 4.0 in.

5. The game board of claim 1 wherein said hinge means of said frame means is positioned on one end thereof, and the hinge means of each said shutter means is positioned on a side thereof such that said frame means with said shutter means in their closed or view blocking positions can be hinged conveniently upwardly for removal or placement of drawing paper on said upper surface of said base means.

6. A multi-segment drawing game method comprising the steps of (a) placing a sheet of drawing paper on a substantially flat support, (b) covering over at least one segment of said paper with a first view blocking shutter means so as to leave a first segment exposed to view, (c) making a drawing of a selected portion of a figure on said first segment, (d) covering over said first segment with a second view blocking shutter means, (e) removing said first view blocking shutter means from a second segment, to expose it to view, (f) making a drawing of another selected portion of said figure on said second segment, (g) repeating steps (d), (e) and (f) but with any number of different additional segments and corresponding additional view blocking means as desired, and (h) removing said shutter means from all of said segments to expose the completely drawn figure to view.

* * * * *